US010488802B2

(12) United States Patent
Takano et al.

(10) Patent No.: US 10,488,802 B2
(45) Date of Patent: Nov. 26, 2019

(54) IMAGE FORMING APPARATUS

(71) Applicant: KONICA MINOLTA, INC., Tokyo (JP)

(72) Inventors: Masahito Takano, Koganei (JP); Jun Onishi, Hino (JP); Takashi Fujiwara, Suginami (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/182,936

(22) Filed: Nov. 7, 2018

(65) Prior Publication Data

US 2019/0137917 A1 May 9, 2019

(30) Foreign Application Priority Data

Nov. 9, 2017 (JP) ..... 2017-216037

(51) Int. Cl.
*G03G 15/00* (2006.01)
*G03G 15/16* (2006.01)

(52) U.S. Cl.
CPC ..... *G03G 15/505* (2013.01); *G03G 15/1615* (2013.01); *G03G 15/5054* (2013.01)

(58) Field of Classification Search
CPC ..... G03G 15/505; G03G 15/1615
See application file for complete search history.

(56) References Cited

U.S. PATENT DOCUMENTS

2009/0034996 A1* 2/2009 Goto ..... G03G 15/161 399/44
2010/0278550 A1* 11/2010 Chiba ..... G03G 15/161 399/66
2011/0058830 A1* 3/2011 Saka ..... G03G 15/167 399/45
2012/0189358 A1* 7/2012 Echigo ..... G03G 15/167 399/302
2013/0223901 A1* 8/2013 Minbe ..... G03G 15/163 399/310
2015/0277302 A1* 10/2015 Birumachi ..... G03G 15/5033 399/66

(Continued)

FOREIGN PATENT DOCUMENTS

JP 2005107118 A 4/2005
JP 2008170615 A 7/2008

*Primary Examiner* — Sevan A Aydin
(74) *Attorney, Agent, or Firm* — Buchanan Ingersoll & Rooney PC

(57) ABSTRACT

An image forming apparatus including: a photoreceptor drum; an intermediate transfer belt; a primary transferer; a secondary transferer, and a hardware processor which suppresses speed change of the intermediate transfer belt at a timing of the sheet entering the secondary transferer and at a timing of the sheet being ejected from the secondary transferer, wherein the hardware processor calculates speed changes of the intermediate transfer belt and the photoreceptor drum at the timing of the sheet entering the secondary transferer and at the timing of the sheet being ejected from the secondary transferer, and calculates a transmission rate between the intermediate transfer belt and the photoreceptor drum based on the calculated speed changes, and the hardware processor adjusts an operation amount of the driving roller based on the calculated transmission rate.

8 Claims, 7 Drawing Sheets

(56) References Cited

U.S. PATENT DOCUMENTS

| | | | | |
|---|---|---|---|---|
| 2015/0346651 | A1* | 12/2015 | Nagata | G03G 15/1605 399/45 |
| 2016/0041508 | A1* | 2/2016 | Kogure | G03G 15/161 399/316 |
| 2016/0216649 | A1* | 7/2016 | Matsuda | G03G 15/1615 |
| 2017/0052485 | A1* | 2/2017 | Yamamoto | G03G 15/5058 |
| 2017/0052487 | A1* | 2/2017 | Hirota | G03G 15/0131 |
| 2017/0102643 | A1* | 4/2017 | Ida | G03G 15/1615 |

* cited by examiner

IMAGE FORMING APPARATUS

BACKGROUND

Technological Field

The present invention relates to an image forming apparatus.

Description of the Related Art

Conventionally, an electrophotographic image forming apparatus which forms a toner image by developing the electrostatic latent image formed on the photoreceptor drum with a toner, transfers the formed toner image onto the sheet by a transferring section, and forms an image on the sheet by heating and fixing the transferred toner image by the fixer, is known.

In such an image forming apparatus, a streak SA1 or an unevenness occurs in the output sample SA (see FIG. 5), since an impact unevenness (primary transfer misalignment, and exposure unevenness) which is caused by the speed change and occurs at the timing of entrance and ejection of the sheet to and from the secondary transferring section deteriorates according to the increase in the thickness and the stiffness of the sheet.

In order to expand the sheet variation of the sheet to be passed, not only using the feedback control, but also combining with the feedforward control which is expected to have more suppressing effect will be effective, since it is necessary to suppress the above impact unevenness. In concrete, the sheet passing speed is kept fixed by the feedback control and the impact change (impact unevenness) at the sheet passing timing is suppressed by the feedforward control.

Since the detection delay and the controlling delay occur in the feedback control, it is not possible to follow the rapid impact change in the cycle of several microseconds which is in the same level as those delay. Therefore, the feedforward control with less effect of the detection delay and the controlling delay is effective as a method to suppress the rapid impact change in the cycle of several microseconds. In the feedforward control, the operation amount of the driving roller of the intermediate transfer belt is set up in advance, and performs the control of an operation amount in accordance with the expected occurrence of the impact change.

For example, a configuration to make the actual belt at a fixed speed by giving, to a belt driving source, in advance the speed increase amount for correcting the speed drop of the belt that occurred at the timing of the entrance of the thick paper to the transfer, is disclosed (for example, see JP 2005-107118(A)). Thus, in the ideal (reproducibility of the waveform is high) state, it is possible to make the impact change to "0" (see FIG. 6A). If the timings of the control and the impact change do not match, the effect of the control lowers (see FIG. 6B).

By the way, if the reproducibility of the waveform lowers from the operation amount decision (development) timing, the effect of the feedforward control becomes weak. Therefore, so as not to drop the effect of the feedforward control, there is a need to adjust the operation amount each time the reproducibility of the waveform drops. The sheet condition (thickness, stiffness, size, and the like) and the state of the apparatus could be given as two large factors for the drop in the waveform reproducibility. That is, there is a need to adjust the operation amount during the working time, since the reproducibility of the waveform drops according to the sheet condition and the state of the apparatus (see FIG. 6C).

By adjusting the operation amount in advance based on the user set up information and the detection result such as sheet variation, size, and the like by the sensor, a definite suppression effect could be seen since the sheet condition and the speed change has a definite correlation. However, it is difficult to assume in advance the "state of the apparatus" such as environmental change like temperature and humidity inside the apparatus, aging such as the abrasion of the parts, and variance among the apparatuses, and digitize the degree of the effect to reflect in the operation amount.

Therefore, the configuration to detect the transfer characteristic from the intermediate transfer belt to the photoreceptor drum by using the test signal from low frequency to high frequency, and to understand the state of the apparatus based on the changing transfer characteristic parameter at the time of image formation state, is disclosed (for example, JP 2008-170615 (A)). Here, the contact coefficient (value showing the cohesion degree between the intermediate transfer belt and the photoreceptor drum) is given as the changing transfer characteristic parameter. As the contact coefficient becomes larger, the cohesion degree between the intermediate transfer belt and the photoreceptor drum increases, and changes the transmission rate from the intermediate transfer belt to the photoreceptor drum. This enables the state of the apparatus to be digitized as a parameter so called as contact coefficient. This means that the photoreceptor drum and the intermediate transfer belt mutually give effect on the respective rotation speeds, since the force functions on the photoreceptor drum through the intermediate transfer belt, and the reaction force functions on the intermediate transfer belt, even if each of the photoreceptor drum and the intermediate transfer belt is attempted to rotate independently.

FIG. 7 shows in what degree the speed change of the intermediate transfer belt transmits to the photoreceptor drum (in concrete, shows the peak-to-peak value (P-P value) (%) measuring the speed change at the timing when 400 sheets are passed). FIG. 8 shows the rate (transmission rate) between the speed change of the intermediate transfer belt and the speed change of the photoreceptor drum.

As shown in FIG. 7 and FIG. 8, the speed change is well transmitted to the photoreceptor drum in state 1, and could be seen that the cohesion degree between the intermediate transfer belt and the photoreceptor drum is strong. On the other hand in state 2, the cohesion degree is gradually becoming weaker (that is, the change is becoming difficult to be transmitted to the photoreceptor drum, and according to this, the speed change in the intermediate transfer belt is becoming larger), and in state 3, the cohesion degree is settled down in a weak state.

As shown above, there is a problem that the suppression effect drops when performing the feedforward control without adjusting the operation amount, since the speed relation between the intermediate transfer belt and the photoreceptor drum corrupts due to the long term change of the cohesion degree between the intermediate transfer belt and the photoreceptor drum (see FIG. 9).

Further, in JP 2008-170615 (A), a test signal from low frequency to high frequency is given to the driving roller of the intermediate transfer belt to measure the cohesion degree between the intermediate transfer belt and the photoreceptor drum. Therefore, if the test signal is given during the image formation, a specific frequency gives an effect to the image and generates color slurring and streak unevenness. There is a need to give the test signal for several ten seconds to several hundred seconds in order to measure the cohesion degree between the intermediate transfer belt and the photoreceptor drum in a case where the test signal is not being given during the image formation to avoid color slurring and streak unevenness. Since the image forming operation need to be interrupted during that period, the productivity drops greatly. It will be sufficient if the transmission rate is being maintained for longer than the measurement period as in state 1 and state 3 in FIG. 8, however, when the measurement is performed when the transmission rate is changing from state 1 to state 2, and then to state 3, the current cohesion degree could not be understood accurately.

SUMMARY

The present invention is made in view of the situation shown above, and an object of the present invention is to suppress the impact unevenness (primary transfer misalignment, and exposure unevenness) at the timing of the sheet passing of the thick sheet, without dropping the productivity and the image quality.

To achieve at least one of the abovementioned objects, according to an aspect of the present invention, an image forming apparatus reflecting one aspect of the present invention includes: a photoreceptor drum; an intermediate transfer belt; a primary transferer which primarily transfers a toner image formed on the photoreceptor drum onto the intermediate transfer belt; a secondary transferer which has a driving roller to rotate the intermediate transfer belt and secondarily transfers onto a sheet the toner image which is primarily transferred onto the intermediate transfer belt by the primary transferer, and a hardware processor which suppresses speed change of the intermediate transfer belt at a timing of the sheet entering the secondary transferer and at a timing of the sheet being ejected from the secondary transferer, wherein the hardware processor calculates speed changes of the intermediate transfer belt and the photoreceptor drum at the timing of the sheet entering the secondary transferer and at the timing of the sheet being ejected from the secondary transferer, and calculates a transmission rate between the intermediate transfer belt and the photoreceptor drum based on the calculated speed changes, and the hardware processor adjusts an operation amount of the driving roller based on the calculated transmission rate.

BRIEF DESCRIPTION OF THE DRAWINGS

The advantages and features provided by one or more embodiments of the invention will become more fully understood from the detailed description given hereinafter and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described in detail with reference to the drawings. However, the scope of the invention is not limited to the disclosed embodiments.

The image forming apparatus 1 according to the embodiment is a tandem type color image forming apparatus, which forms a color image on the sheet by the electrophotographic manner, based on the image data obtained by reading the image from the document or the image data received from the external device.

Figure 1:
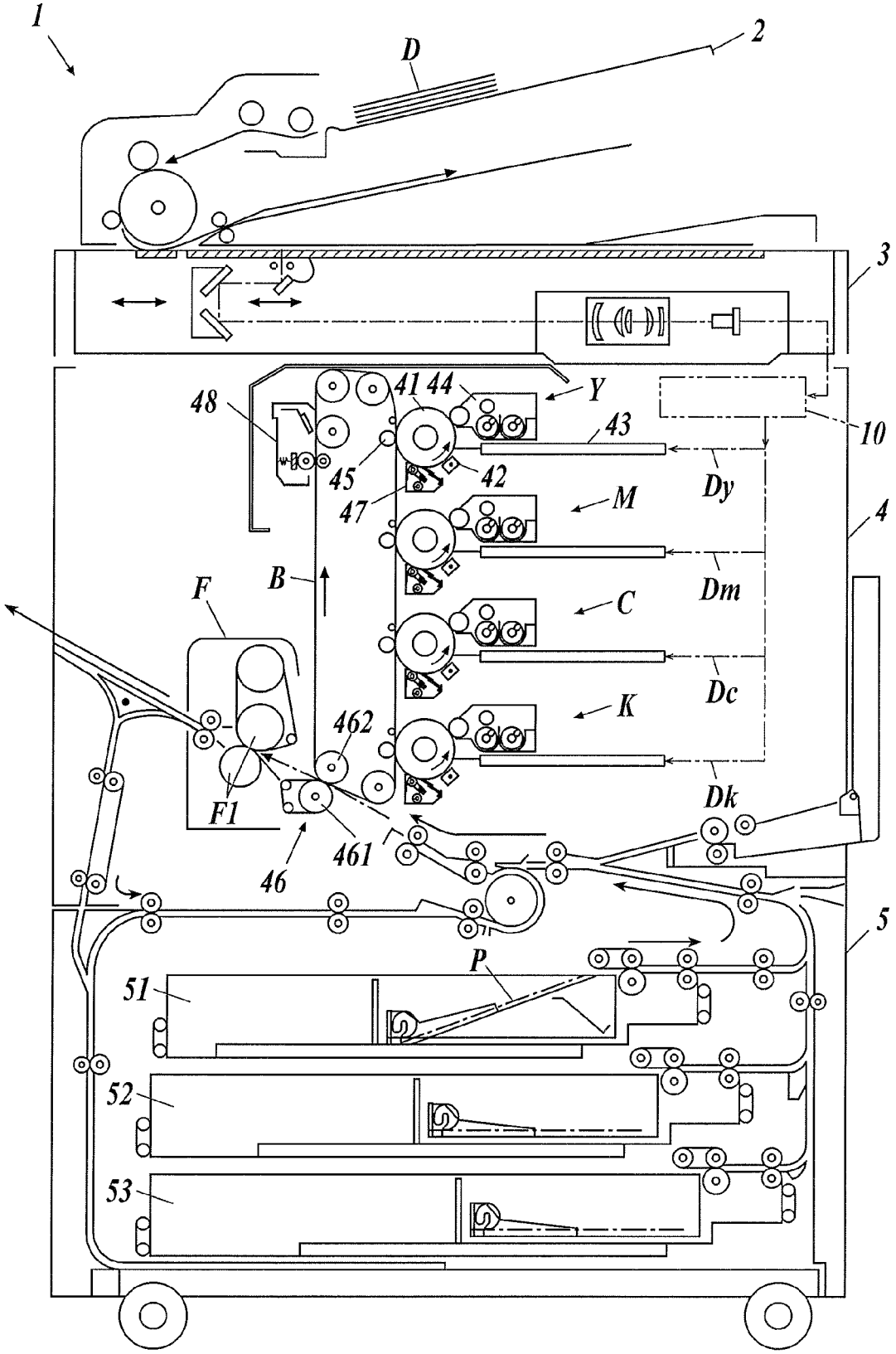
FIG. 1 is a figure showing the configuration outline of the image forming apparatus according to the embodiment.
Figure 2:
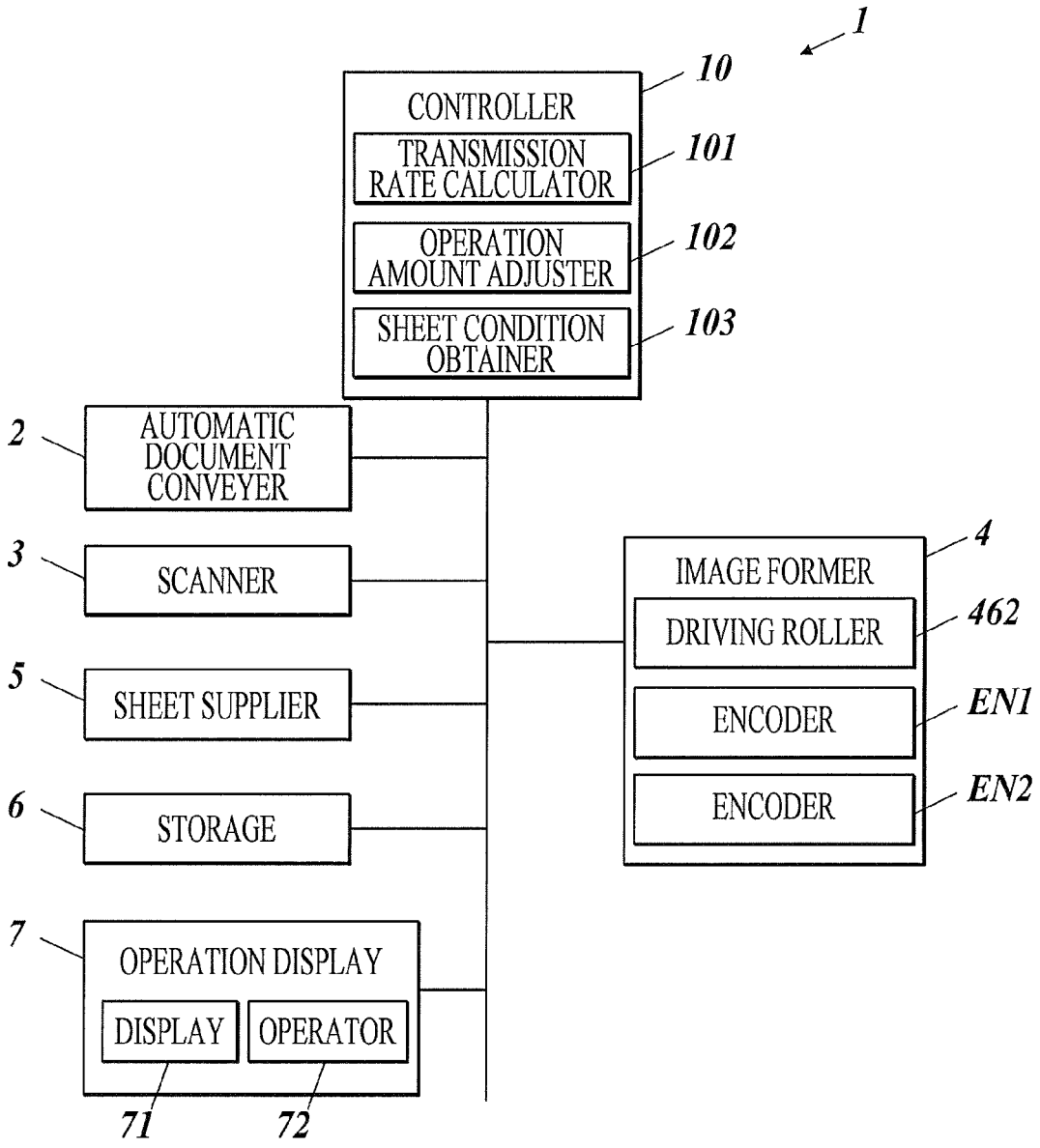
FIG. 2 is a functional block diagram showing the control structure of the image forming apparatus according to the embodiment.

The image forming apparatus 1 is configured including automatic document conveyer 2, scanner 3, image former 4, sheet supplier 5, storage 6, operation display 7, and controller 10 as shown in FIG. 1 and FIG. 2. Further, the controller 10 is configured including transmission rate calculator 101, operation amount adjuster 102, and sheet condition obtainer 103 as shown in FIG. 2. Further, storage 6 and operation display 7 are shown in FIG. 2.

The automatic document conveyer 2 is configured including mounting tray to mount the document D, structure to convey the document D and conveyance rollers and the like so as to convey the document D to the predetermined conveyance path.

The scanner 3 is configured including light source and optical system such as reflector, irradiates the light source to the document D which is conveyed to the predetermined conveyance path or is mounted on the platen glass, and receives the reflection light. Further, the scanner 3 converts the received reflection light to an electrical signal and outputs it to the controller 10.

The image former 4 is configured including yellow image former Y, magenta image former M, cyan image former C, black image former K, intermediate transfer belt B, and fixer F.

Each image former YMCK respectively forms yellow, magenta, cyan, and black toner image in photoreceptor drum 41, and primary transfers the toner image of each of Y, M, C, and K colors formed on the photoreceptor drum 41 on the intermediate transfer belt B.

Further, the configuration and the operation of each YMCK image formers are the same, therefore hereinafter, yellow image former Y will be taken as an example to describe the series of image forming operation done by the image former 4.

The photoreceptor drum 41 is configured by organic photoreceptor in which a photoreceptor layer made by resin including the organic photoconductor is formed on the outer periphery of the drum-like metal substrate, and rotated in the anti-clockwise direction in the figure. As for the resin configuring the photoreceptor layer, for example, polycarbonate resin, silicone resin, polystyrene resin, acrylic resin, methacrylic resin, epoxy resin, polyurethane resin, vinyl chloride resin, melamine resin, and the like are given.

The electrifier 42 electrifies the photoreceptor drum 41 to a fixed electric potential by using the electrification charger.

The exposurer 43 removes the electric charge in the exposing portion by exposing the non-image region in the photoreceptor drum 41 based on the image data Dy from the controller 10, and forms an electrostatic latent image in the image region of the photoreceptor drum 41.

The developer 44 supplies a toner, which is a developing agent, on the electrostatic latent image formed on the photoreceptor drum 41, and forms a yellow toner image on the photoreceptor drum 41.

The primary transfer roller (primary transferer) 45 primarily transfers a yellow toner image formed on the photoreceptor drum 41 to the intermediate transfer belt B.

Further, the other image formers M, C, and K primarily transfer the toner images of magenta, cyan, and black on the intermediate transfer belt B as well as the yellow toner image. This forms the toner image with each color of Y, M, C and K on the intermediate transfer belt B.

The intermediate transfer belt B is a semiconductive endless belt which is suspended by plurality of rollers including the driving roller 462 and supported so that the intermediate transfer belt B is able to rotate, and the intermediate transfer belt B is rotated clockwise in the figure in accordance with rotation of the rollers. The intermediate transfer belt B contacts each of the facing photoreceptor drums 41 with a pressure by the primary transfer roller 45. In each of the primary transfer rollers 45, the transfer electric current flows according to the voltage applied. Therefore, the toner images developed on the surfaces of the respective photoreceptor drums 41 are primarily transferred onto the intermediate transfer belt B by the respective primary transfer rollers 45, one after another.

The secondary transfer device (secondary transferer) 46 is configured including secondary transfer roller 461, driving roller 462 to rotate the intermediate transfer belt B, and secondarily transfers, on the sheet P, the toner image which was first transferred on the intermediate transfer belt B. The secondary transfer roller 461 is in pressure contact with the intermediate transfer belt B, and the driving roller 462 configures one among the plurality of rollers which swathes the intermediate transfer belt B. The secondary transfer device 46 secondarily transfers the toner image on the intermediate transfer belt B onto the sheet P conveyed from the sheet feeding trays 51 to 53 of the sheet supplier 5, by the sheet P passing through the transfer nip formed between the secondary transfer roller 461 and the driving roller 462 making a pair.

The fixer F is configured including the fixing roller pair F1, and performs a fixing process fixing the toner image transferred on to the sheet P. The fixing roller pair F1 fixes the image on the sheet by heating and pressurizing the sheet P on which the toner image is transferred, by sheet P passing through the fixing nip formed between the rollers making a pair.

The image former 4 ejects the sheet P on which the toner image with each color of Y, M, C and K is secondary transferred, outside the apparatus through the predetermined conveyance route after the sheet P is heated and pressurized by the fixer F.

This is the series of the image formation operation by the image former 4.

Further, besides configuring the fixer F with a pair of rollers (fixing roller pair F1), the configuration made by a pair of rotating members such as the belt type using a belt and a pad type using a pad could widely be adopted.

The cleaner 47 removes residual substance which is remaining on the surface of the photoreceptor drum 41 after the primary transfer such as residual toner and paper powder. The cleaner 47 adopts the blade cleaning method which contacts the plate-like (sheet-like) elastic bodied (for example, polyurethane rubber) cleaning blade to the photoreceptor drum 41.

Further, the cleaner 48 removes the residual substance remaining on the intermediate transfer belt B after the secondary transfer.

Further, encoders EN1 and EN2 which are for detecting the speed, are attached on the rotation shafts of the photoreceptor drum 41 and the driving roller 462.

The encoder EN1 attached on the rotation shaft of the photoreceptor drum 41 and the encoder EN2 attached on the rotation shaft of the driving roller 462 each outputs the speed detected respectively to the detector 10.

The sheet supplier 5 is configured including plurality of sheet feeding trays 51 to 53, and different kinds of sheet P are stored in the sheet feeding trays 51 to 53. The sheet supplier 5 feeds the image former 4 with the stored sheet P through the predetermined conveyance route.

The storage 6 is configured with HDD (Hard Disk Drive), semiconductor memory and the like, and stores data such as program data and various setting data in the form which could be read and written from the controller 10.

Figure 4A:
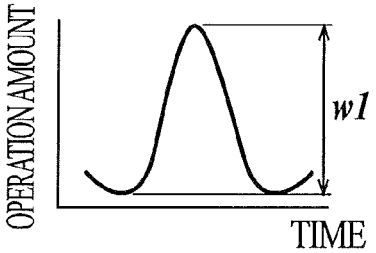
FIG. 4A is a figure showing an example of the operation amount table corresponding to a case where the transmission rate is small.
Figure 4B:
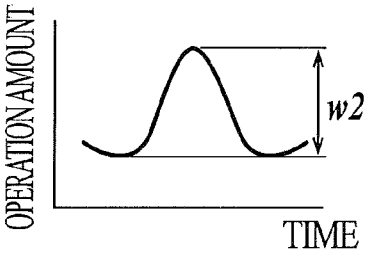
FIG. 4B is a figure showing an example of the operation amount table corresponding to a case where transmission rate is medium.

The storage 6 stores the operation amount table (see FIG. 4) showing the operation amount of the driving roller 462 at the timing of the feedforward control, which is arranged according to the transmission rate (contact degree) of intermediate transfer belt B and photoreceptor drum 41.

Here, the transmission rate between intermediate transfer belt B and photoreceptor drum 41 is the transmission rate of the speed change from the intermediate transfer belt B to the photoreceptor drum 41 which could be calculated by "peak-to-peak value (P-P value) of the speed change of the photoreceptor drum 41/P-P value of the speed change of the intermediate transfer belt".

Figure 4C:
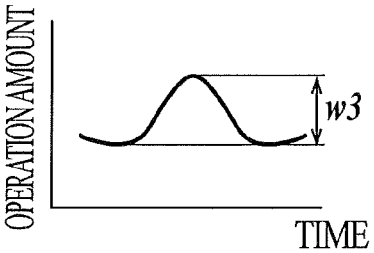
FIG. 4C is a figure showing an example of the operation amount table corresponding to a case where transmission rate is large.
Figure 5:
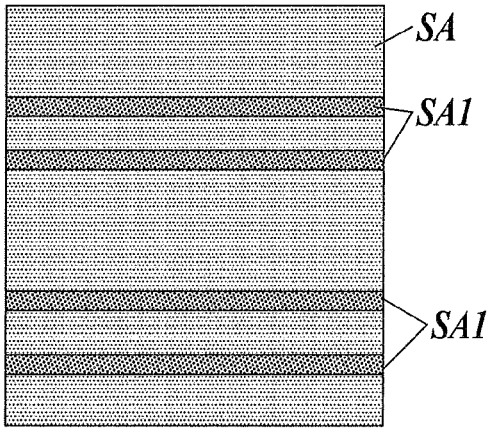
FIG. 5 is a figure showing an example of the output sample when the streak unevenness occurred.
Figure 6A:
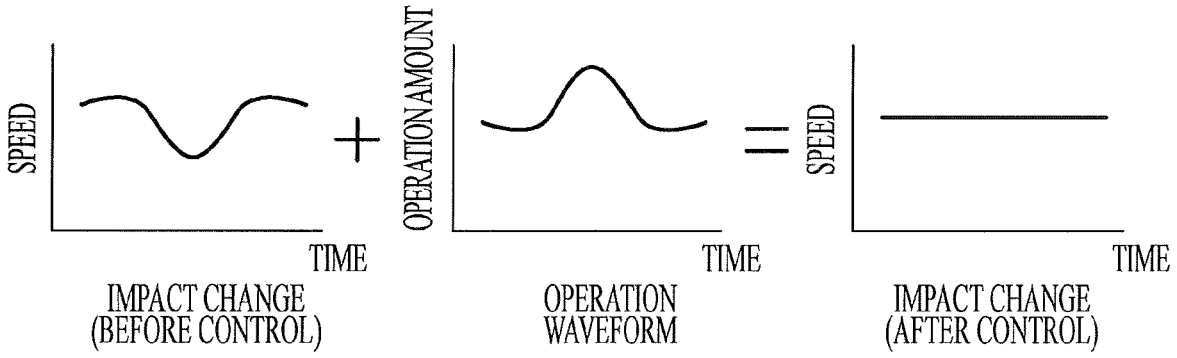
FIG. 6A is a figure showing an example of the speed change after the feedforward control.
Figure 6B:
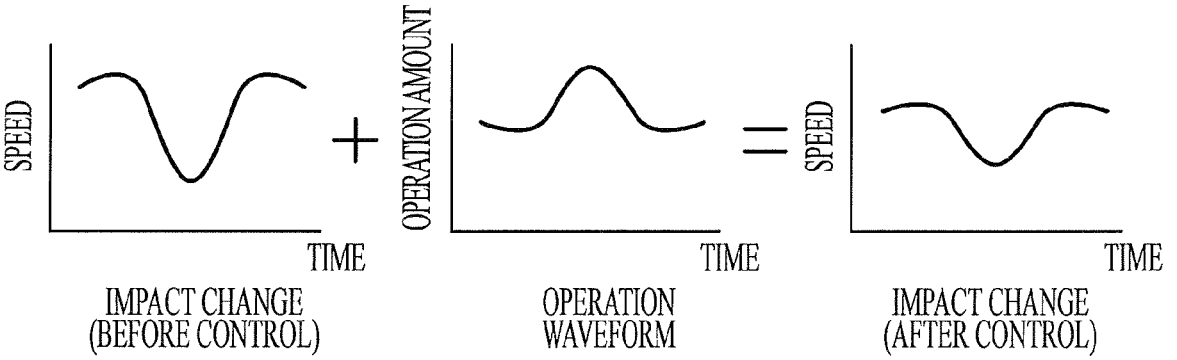
FIG. 6B is a figure showing an example of the speed change after the feedforward control.
Figure 6C:
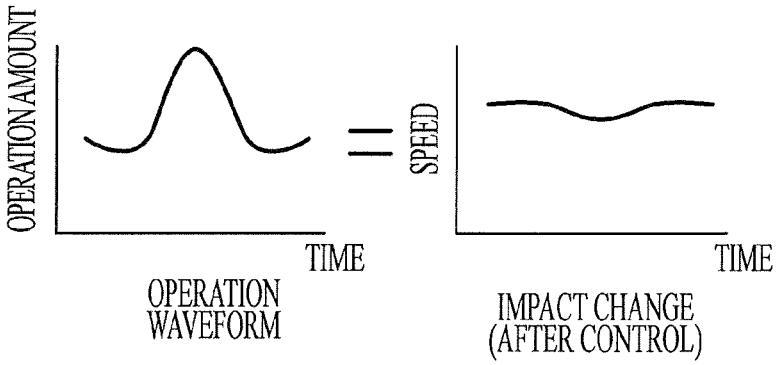
FIG. 6C is a figure showing an example of the speed change after the feedforward control.
Figure 7:
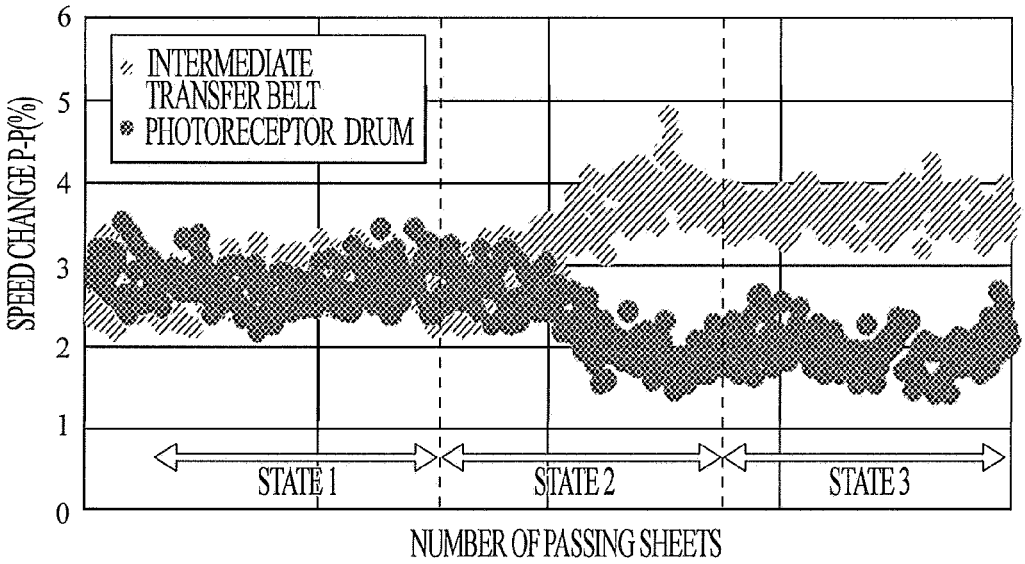
FIG. 7 is a figure showing an example of the speed change in the intermediate transfer belt and the photoreceptor drum.
Figure 8:
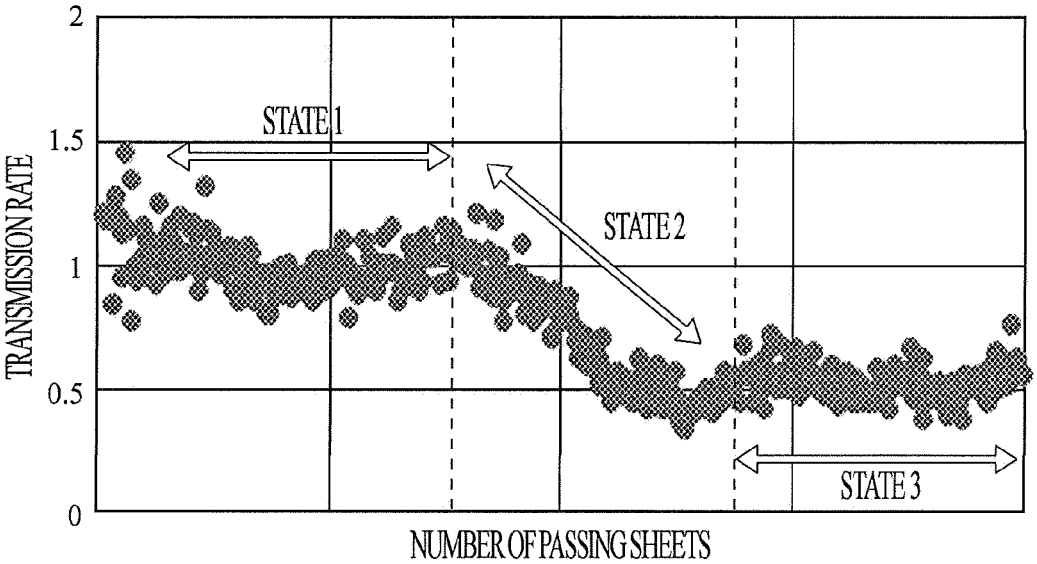
FIG. 8 is a figure showing the ratio of the speed change (transmission rate) in the intermediate transfer belt and the photoreceptor drum.
Figure 9:
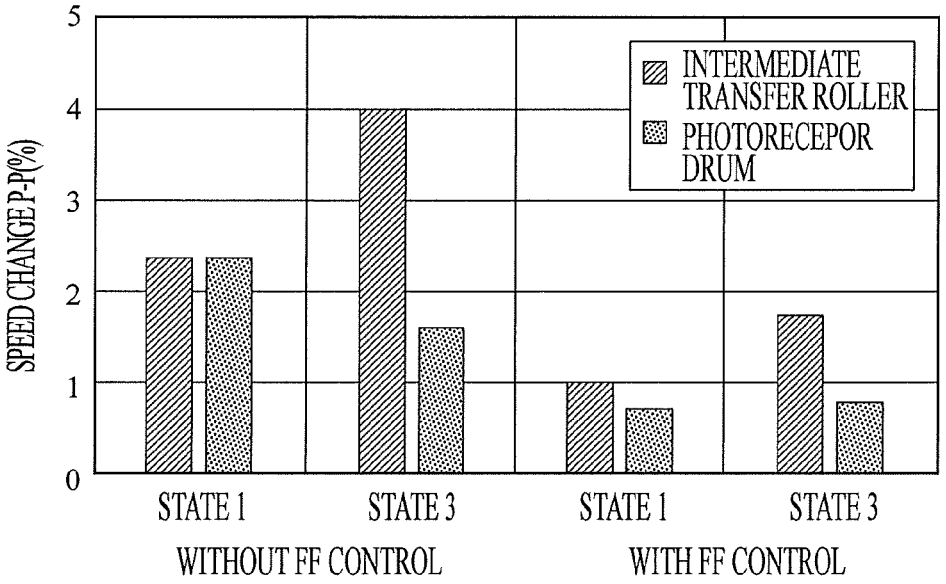
FIG. 9 is a figure showing the relation between the performing or not performing the feedforward control and the speed changes of the intermediate transfer belt and the photoreceptor drum.

In the embodiment, three operation amount tables are arranged in advance, such as operation amount table corresponding to small transmission rate (see FIG. 4A), operation amount table corresponding to medium transmission rate (see FIG. 4B), and operation amount table corresponding to large transmission rate (see FIG. 4C).

The operation display 7 is configured by a liquid crystal display (LCD) with a touch panel, and functions as display 71 and operator 72, for example.

The display 71 performs display of various operation screens, operation condition of each functions and the like, according to the display control signal input from the controller 10. Further, the touch operation by the user is accepted and the operation signal is output in the controller 10.

The operator 72 includes various operation key such as ten key, start key, and the like, and accepts the various input operation by the user and outputs the operation signal to the controller 10. The user is able to perform image quality setting, magnification setting, application setting, setting relating to image forming such as output setting, sheet setting and the like, sheet conveyance order, and stop operation of the devise by operating the operation display 7.

The controller 10 is configured including CPU, RAM, ROM, and the like. The CPU presents in the RAM the various programs stored in the ROM, and by cooperating with the various presented programs, the operation of each section of the image forming apparatus 1 such as, automatic document conveyer 2, scanner 3, image former 4, sheet supplier 5, storage 6, operation display 7, are controlled integrally (see FIG. 2). For example, the controller 10 performs various image process by making an input of the electrical signal from the scanner 3, and outputs the image data Dy, Dm, Dc, and Dk which are the image data of each colors of YMCK and are generated by the image processing, to the image former 4. Further, the controller 10 forms the image on sheet P by controlling the operation of the image former 4.

Further, the controller 10 steadily operates the feedback control to maintain the sheet passing speed (the speed of the intermediate transfer belt B (driving roller 462)) at a fixed speed, based on the speed (change) of the driving roller 462 detected by the encoder EN2 attached on the roller shaft of the driving roller 462.

Further, the controller 10 suppresses the speed change of the intermediate transfer belt B at the timing when the sheet enters the secondary transfer device 46, and at the timing when the sheet is ejected from the secondary transfer device 46.

Figure 3:
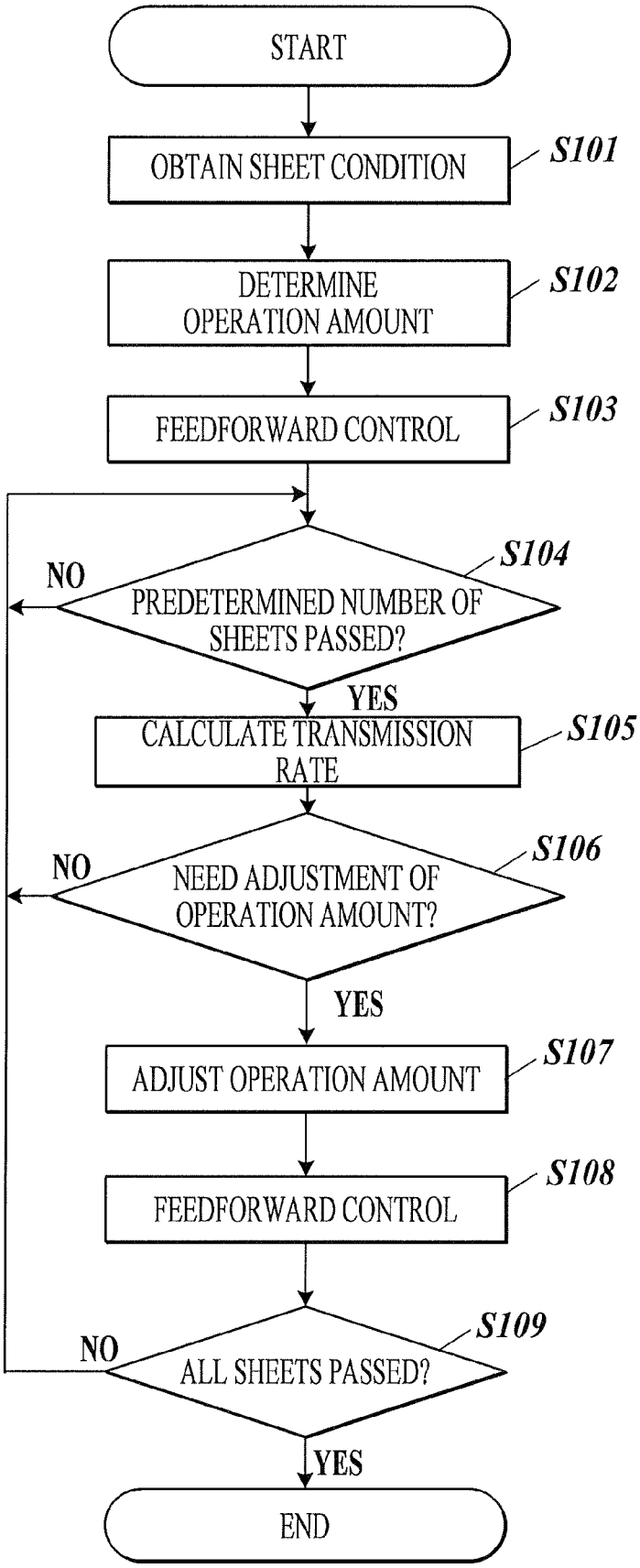
FIG. 3 is a flowchart showing the operation of the image forming apparatus according to the embodiment.

Next, the operation of the image forming device 1 according to the embodiment will be described referring to the flowchart in FIG. 3. This operation starts in the opportunity when the controller 10 receives the print job and begins sheet passing.

First, the controller 10 obtains the sheet condition according to the sheet to be passed (step S101). That is, the controller 10 functions as the sheet condition obtainer 103 of the present invention. As for the sheet condition, weight, thickness, stiffness, size (especially the length in the main scanning direction) and the like are given, for example.

Next, the controller 10 determines the operation amount of the driving roller 462 referring to the operation amount table (see FIG. 4) according to the assumed transmission rate (to be more accurate, according to the transmission rate which is closest to the assumed transmission rate) by assuming the transmission rate between intermediate transfer belt B and photoreceptor drum 41 based on the sheet condition obtained in step S101 (step S102). Here, the operation amount of the driving roller 462 is PWM (Pulse Width Modulation) value of the motor driving the driving roller 462 and voltage value, for example.

Next, the controller performs the feedforward control based on the operation amount determined in step S102, at the timing when the speed change occurs in the intermediate transfer belt B by the sheet passing (entrance and ejection of the sheet to and from the secondary transfer device 46) (step S103).

Next, the controller 10 decides whether or not the sheet passing of the predetermined number of sheet is done (step S104). Here, the predetermined number is a number having a possibility that the transmission rate between intermediate transfer belt B and photoreceptor drum 41 might change due to the accumulation of the speed changes of the intermediate belt B and the photoreceptor drum 41. For example, the predetermined number in the embodiment is five. Further, the predetermined number is not limited to the example given above, but could be one or ten, for example.

That is, since the change in the transmission rate is within units of several tens to several hundreds of sheets, the detection cycle of the speed change could be in every one to several sheets, or be in the moving average of several sheets. However, it is preferred for the calculation of the speed change to be made within the number of sheets at a certain degree (for example, five sheets), since, if the predetermined number is one, the feedforward control might be performed in relation to a mere unevenness of the speed change.

If the controller 10 determines the sheet passing of the predetermined number of sheets is made (step S104: YES), it moves on to the next step S105.

On the other hand, if the controller 10 determines the sheet passing of the predetermined number of sheets is not made (step S104: No), it repeats the process of step S104 until the sheet passing of the predetermined number of sheets is made.

Next, the controller 10 calculates the speed changes of photoreceptor drum 41 and intermediate transfer belt B (driving roller 462) based on the speeds of the photoreceptor drum 41 and the driving roller 462 output from encoders EN1 and EN2. The transmission rate between intermediate transfer belt B and photoreceptor drum 41 are calculated based on the calculated speed change (step S105). That is, the controller 10 functions as the transmission rate calculator 101 of the present invention. In concrete, the controller 10 calculates the movement averages of the speed changes of photoreceptor drum 41 and intermediate transfer belt B for the predetermined number of sheets, and calculates the transmission rate between intermediate transfer belt B and photoreceptor drum 41 based on the calculated movement averages of the speed changes, for example.

Next, the controller 10 decides whether or not there is a need to adjust the operation amount of the driving roller 462, based on the transmission rate calculated in step S105 (step S106). In concrete, the controller 10 decides that there is a need to adjust the operation amount of the driving roller 462 when the transmission rate calculated in step S105 changed for the predetermined value or more from the transmission rate assumed in step S102, and a need of changing the referring operation amount table occurs, for example.

If the controller 10 decides that there is a need to adjust the operation amount of the driving roller 462 (step S106: YES), it moves on to the next step S107.

On the other hand, if the controller 10 decides that there is no need to adjust the operation amount of the driving roller 462 (step S106: No), it moves to step S104 and repeats the process on and after step S104 again.

Next, the controller 10 refers to the operation table (see FIG. 4) according to the transmission rate calculated in step S105, to adjust the operation amount of the driving roller 462 (step S107). That is, the controller 10 functions as the operation adjuster 102 of the present invention. In concrete, the controller 10 adjusts (linear interpolation) the operation amount of the driving roller 462 according to the proportion of the difference from the small transmission rate and the difference from the medium transmission rate, if the transmission rate calculated in step S105 is in between small transmission rate and medium transmission rate shown in FIG. 4, for example.

When, P-P value of the speed change of the intermediate transfer belt B calculated in step S105 stands as U, P-P value of the speed change of the photoreceptor drum 41 stands as V, P-P value of the speed change of the intermediate transfer belt B in small transmission rate (see FIG. 4A) stands as u1, P-P value of the speed change of the photoreceptor drum 41 stands as v1, P-P value of the speed change of the intermediate transfer belt B in medium transmission rate (see FIG. 4B) stands as u2, P-P value of the speed change of the photoreceptor drum 41 stands as v2, operation amount for small transmission rate (see FIG. 4A) stands as w1, and operation amount for medium transmission rate (see FIG. 4B) stands as w2, the operation amount W to be adjusted could be calculated with the numerical function (1) shown below.

$$W=((U/V)-(u2/v2))/((u1/v1)-(u2/v2))\times w1+(u1/v1)-(U/V))/((u1/v1)-(u2/v2))\times w2 \quad \text{Numerical Function (1);}$$

Further, the controller 10 adjusts the operation amount of the driving roller 462 according to the proportion of the difference from the medium transmission rate and the difference from the large transmission rate, if the transmission rate calculated in step S105 is between medium transmission rate and large transmission rate shown in FIG. 4.

Next, the controller 10 performs the feedforward control based on the operation amount adjusted in step S107 (step S108) at the timing when the speed change occurs in the intermediate transfer belt B by the sheet passing (entrance and ejection of the sheet to and from the secondary transfer device 46).

Further, in the case where the adjusted operation amount is reflected to the control, it could be done for every one to several sheets as well as the detection cycle of the speed change. For example, the adjusted operation amount could be reflected on the second sheet after the speed change is detected in the first sheet, or could be reflected with an interval of a plurality of sheets. Further, the adjusted operation amount could be reflected on every sheet, or could be reflected with an interval of a plurality of sheets based on the average value of the speed changes for a plurality of sheets.

Next, the controller 10 decides whether all of the sheets are passed or not (step S109).

The process ends, if the controller 10 decides all of the sheets are passed (step S109: YES).

On the other hand, if the controller 10 decides all of the sheets are not passed (step S109: NO), the step moves on to step S104 and repeats the process on and after step S104 again.

Therefore, the image forming apparatus 1 according to the embodiment includes, photoreceptor drum 41, intermediate transfer belt B, primary transferer (primary transfer roller 45) which primarily transfers the toner image formed on the photoreceptor drum 41 to the intermediate transfer belt B, driving roller 462 to rotate the intermediate belt B, and includes secondary transferer (secondary transfer device 46) which secondarily transfers the toner image primary transferred on the intermediate transfer belt B by the primary transferer on a sheet, controller 10 suppressing the speed change of the intermediate transfer belt B at the timing of entrance and at the timing of ejection of the sheet to and from the secondary transferer. Further, the controller 10 includes a transmission rate calculator 101 which calculates speed changes of the intermediate transfer belt B and the photoreceptor drum 41 at the timing of the sheet entering the secondary transferer and at the timing of the sheet being ejected from the secondary transferer, and calculates a transmission rate between the intermediate transfer belt B and the photoreceptor drum 41 based on the calculated speed changes, and an operation amount adjustor 102 which adjusts an operation amount of the driving roller 462 based on the transmission rate calculated by the transmission rate calculator 101.

Therefore, the image forming apparatus 1 according to the embodiment can adjust the operation amount of the feedforward control, which counteracts the speed change, to an appropriate value, even if the contact degree of the intermediate transfer belt and the photoreceptor drum changes. Further, it is possible to measure the contact degree of intermediate transfer belt and photoreceptor drum without giving the test signal during the image formation. Therefore, it is possible to continuously suppress the impact unevenness (primary transfer misalignment, and exposure unevenness) at the timing of sheet passing of a thick sheet without dropping productivity and image quality.

Further, the image forming apparatus 1 according to the embodiment includes a storage 6 which stores plurality of operation amounts of the driving roller 462 according to the transmission rate between intermediate transfer belt B and photoreceptor drum 41. Further, the operation amount adjuster 102 adjusts the operation amount of the driving roller 462 based on the transmission rate calculated by the transmission rate calculator 101, and the operation amount stored in the storage 6.

Therefore, according to the image forming apparatus 1 in the embodiment, an appropriate operation amount could easily be calculated from the calculated transmission rate, and the adjustment of the operation amount at the timing of the feedforward control could easily be made.

Further, according to the image forming apparatus 1 of the embodiment, the controller 10 includes the sheet condition obtainer 103 which obtains the sheet condition relating to the sheet being sheet passed. Further, the operation amount adjuster 102 also assumes the transmission rate between intermediate transfer belt B and photoreceptor drum 41 based on the sheet condition obtained by the sheet condition obtainer 103, and adjusts the operation amount of the driving roller 462 based on the assumed transmission rate.

Therefore, according to the image forming apparatus 1 in the embodiment, the productivity relating to the image formation could be improved since the feedforward control could be performed from the beginning of the print job.

Above, the embodiment according to the present invention was described in concrete, however, the present invention is not limited to the stated embodiment, but could be changed in the range of the points of the present invention.

For example, in the embodiment, a plurality of operation amounts of the driving roller 462 according to transmission rates of intermediate transfer belt B and photoreceptor drum 41 are stored in the storage 6, and the operation amount of the driving roller 462 is adjusted based on calculated transmission rate and operation amount stored in the storage 6, however the present invention is not limited to this. It is sufficient that the operation amount of the driving roller 462 according to the transmission rate between intermediate belt B and photoreceptor drum 41 and the regression formula showing the relationship between the transmission rate and the operation amount are stored in the storage 6, and the operation amount of the driving roller 462 could be adjusted based on the calculated transmission rate, operation amount stored in the storage 6, and regression formula stored in the storage 6, for example.

By including the above configuration, the operation amount at the timing of the feedforward control could easily be adjusted, since the appropriate operation amount could easily be calculated by the calculated transmission rate.

Further, as another example, when the calculated transmission rate exceeds the predetermined range, the sheet passing operation could be stopped, for example. Here, the predetermined range is a range where there is no concern of the transfer being interfered by the contact degree of intermediate transfer belt B and photoreceptor drum 41. When the predetermined range is exceeded, the contact degree becomes weaker or stronger, and may result in interfere of the transfer.

As shown above, when the calculated transmission rate exceeds the predetermined range, it is possible to suppress the occurrence of malfunction in image forming, since it is possible to suppress the occurrence of trouble in transfer by stopping the sheet passing operation.

Further, as another example, it is sufficient to perform a predetermined control to keep the transmission rate within the predetermined range, when the calculated transmission rate exceeds the predetermined range. Here, as for the predetermined control, there is a control to change at least one of a pressing level of the primary transfer roller 45, a primary transfer current, a primary transfer voltage, a toner density, speeds of the intermediate transfer belt B and the photoreceptor drum 41 and a temperature inside the apparatus.

For example, if the contact degree of intermediate transfer belt B and photoreceptor drum 41 are too weak, that can be performed a control such that the contact degree (transmission rate) of intermediate transfer belt B and photoreceptor drum 41 could be made stronger by raising the pressing level of the primary transfer roller 45, raising the first transfer current, raising the primary transfer voltage, weaken the toner density, reducing the speed difference between intermediate transfer belt B and photoreceptor drum 41, or raising the temperature inside the apparatus.

On the other hand, if the contact degree of intermediate transfer belt B and photoreceptor drum 41 are too strong, there can be performed a control such that the contact degree (transmission rate) of intermediate transfer belt B and photoreceptor drum 41 could be made weaker by lowering the pressing level of the primary transfer roller 45, lowering the first transfer current, lowering the primary transfer voltage, strengthening the toner density, increasing the speed difference between intermediate transfer belt B and photoreceptor drum 41, or lowering the temperature inside the apparatus.

As shown above, when the calculated transmission rate exceeds the predetermined range, it is possible to suppress the occurrence of the malfunction at the timing of image forming without lowering the productivity since a predetermined control is performed so that the transmission rate keeps inside the predetermined range to suppress the occurrence of the malfunction at the timing of transfer.

Further, as another example, when the calculated transmission rate exceeds the first predetermined range, the predetermined control to keep the transmission rate in the first predetermined range is performed and furthermore, when the calculated transmission rate includes the first predetermined range and exceeds the second predetermined range which is broader than the first predetermined range, the sheet passing operation may be stopped. Here, the first predetermined range is a range where there is no concern that the contact degree of intermediate transfer belt B and photoreceptor drum 41 will interfere the transfer. Further, the second predetermined range is a range which includes the range where the contact degree of intermediate transfer belt B and photoreceptor drum 41 becomes weaker than the first predetermined range and the range where the contact degree becomes stronger than the first predetermined range, but which has no concern of the interfere in the transfer.

By including the configuration above, the occurrence of the malfunction at the timing of image forming could be more surely suppressed without lowering the productivity as much as it could, by suppressing the occurrence of interfere at the timing of transfer.

Further, as for the detailed configuration and detailed operation of each device configuring the image forming apparatus, modifications can be appropriately made within the scope of the present invention.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent Application No. 2017-216037, filed on Nov. 9, 2017, is incorporated herein by reference in its entirety.

What is claimed is:

1. An image forming apparatus comprising:

a photoreceptor drum;

an intermediate transfer belt;

a primary transferer which primarily transfers a toner image formed on the photoreceptor drum onto the intermediate transfer belt;

a secondary transferer which has a driving roller to rotate the intermediate transfer belt and secondarily transfers onto a sheet the toner image which is primarily transferred onto the intermediate transfer belt by the primary transferer, and a hardware processor which suppresses speed change of the intermediate transfer belt at a timing of the sheet entering the secondary transferer and at a timing of the sheet being ejected from the secondary transferer, wherein the hardware processor calculates speed changes of the intermediate transfer belt and the photoreceptor drum at the timing of the sheet entering the secondary transferer and at the timing of the sheet being ejected from the secondary transferer, and calculates a transmission rate between the intermediate transfer belt and the photoreceptor drum based on the calculated speed changes, and the hardware processor adjusts an operation amount of the driving roller based on the calculated transmission rate.

2. The image forming apparatus according to claim 1, comprising a storage which stores a plurality of operation amounts of the driving roller according to a transmission rate between the intermediate transfer belt and the photoreceptor drum, wherein the hardware processor adjusts the operation amount of the driving roller based on the calculated transmission rate, and the operation amount stored in the storage.

3. The image forming apparatus according to claim 1, comprising a storage which stores an operation amount of the driving roller according to a transmission rate between the intermediate transfer belt and the photoreceptor drum, and a regression formula showing a relationship between the transmission rate and the operation amount, wherein the hardware processor adjusts the operation amount of the driving roller based on the calculated transmission rate, the operation amount stored in the storage, and the regression formula stored in the storage.

4. The image forming apparatus according to claim 1, wherein the hardware processor stops a sheet passing operation when the calculated transmission rate exceeds a predetermined range.

5. The image forming apparatus according to claim 1, wherein the hardware processor performs a predetermined control to keep the transmission rate within a predetermined range when the calculated transmission rate exceeds the predetermined range.

6. The image forming apparatus according to claim 1, wherein the hardware processor performs a predetermined control to keep the transmission rate within a first predetermined range when the calculated transmission rate exceeds the first predetermined range, and the hardware processor stops a sheet passing operation when the calculated transmission rate exceeds a second predetermined range which includes the first predetermined range and is broader than the first predetermined range.

7. The image forming apparatus according to claim 5, wherein the hardware processor performs a control to change at least one of a pressing level of the primary transferer, a primary transfer current, a primary transfer voltage, a toner density, speeds of the intermediate transfer belt and the photoreceptor drum and a temperature inside the apparatus, as the predetermined control.

8. The image forming apparatus according to claim 1, wherein the hardware processor obtains a sheet condition according to the sheet which is to be passed, and the hardware processor assumes a transmission rate between the intermediate transfer belt and the photoreceptor drum based on the obtained sheet condition, and adjusts the operation amount of the driving roller based on the assumed transmission rate.

* * * * *